United States Patent [19]

Myers

[11] 4,438,998

[45] Mar. 27, 1984

[54] MODULAR PLUG-DIAL MODULAR JACK ADAPTOR

[75] Inventor: Ronald W. Myers, Landisburg, Pa.

[73] Assignee: AMP Incorporated, Harrisburg, Pa.

[21] Appl. No.: 378,301

[22] Filed: May 14, 1982

Related U.S. Application Data

[63] Continuation-in-part of Ser. No. 354,974, Mar. 5, 1982.

[51] Int. Cl.[3] ..... H01R 13/518

[52] U.S. Cl. ..... 339/154 A; 339/176 M

[58] Field of Search ..... 339/154 A, 159 R, 176 M

[56] References Cited

U.S. PATENT DOCUMENTS 4,153,327 5/1979 Johnson ..... 339/205

4,241,974 12/1980 Hardesty ..... 339/154 A 4,273,402 6/1981 Hughes ..... 339/91 R 4,295,702 10/1981 Snyder ..... 339/97 P 4,315,664 2/1982 Hughes et al. ..... 339/176 M

*Primary Examiner*—Eugene F. Desmond

*Attorney, Agent, or Firm*—Frederick W. Raring

[57] ABSTRACT

A modular plug-dual modular jack adaptor is disclosed. The adaptor is comprised of a two piece molded housing having a plurality of one piece uninsulated conductor members therein, which can engage directly with the contacts in other modular jacks and plugs. The conductor members are made from stamped and formed sheet metal or wire. The adaptor is intended to provide multiple jack access at a single jack location.

10 Claims, 3 Drawing Figures

Fig. 2
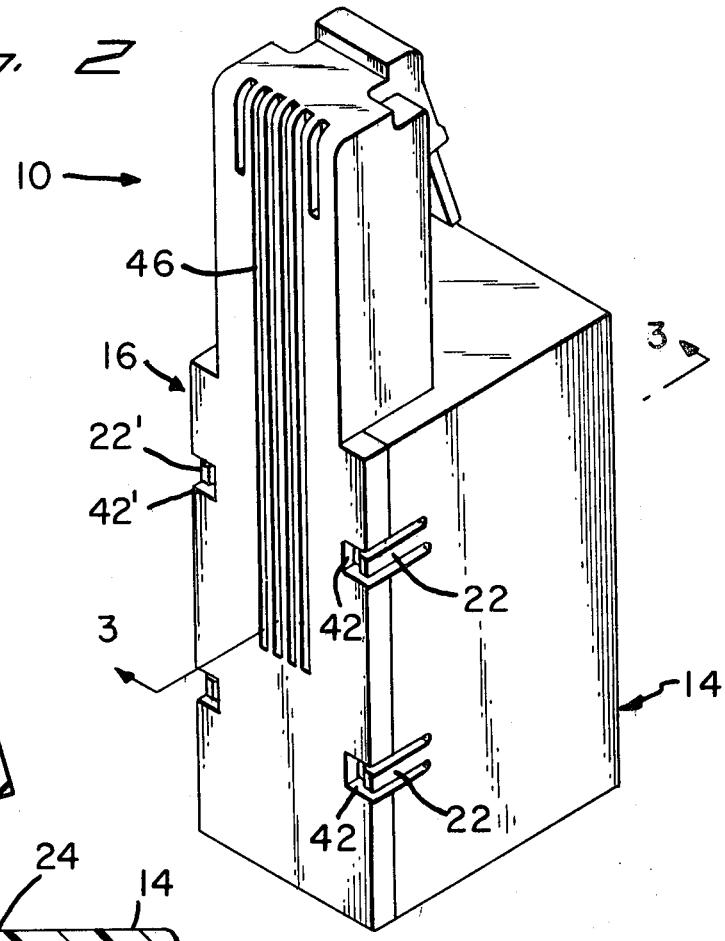
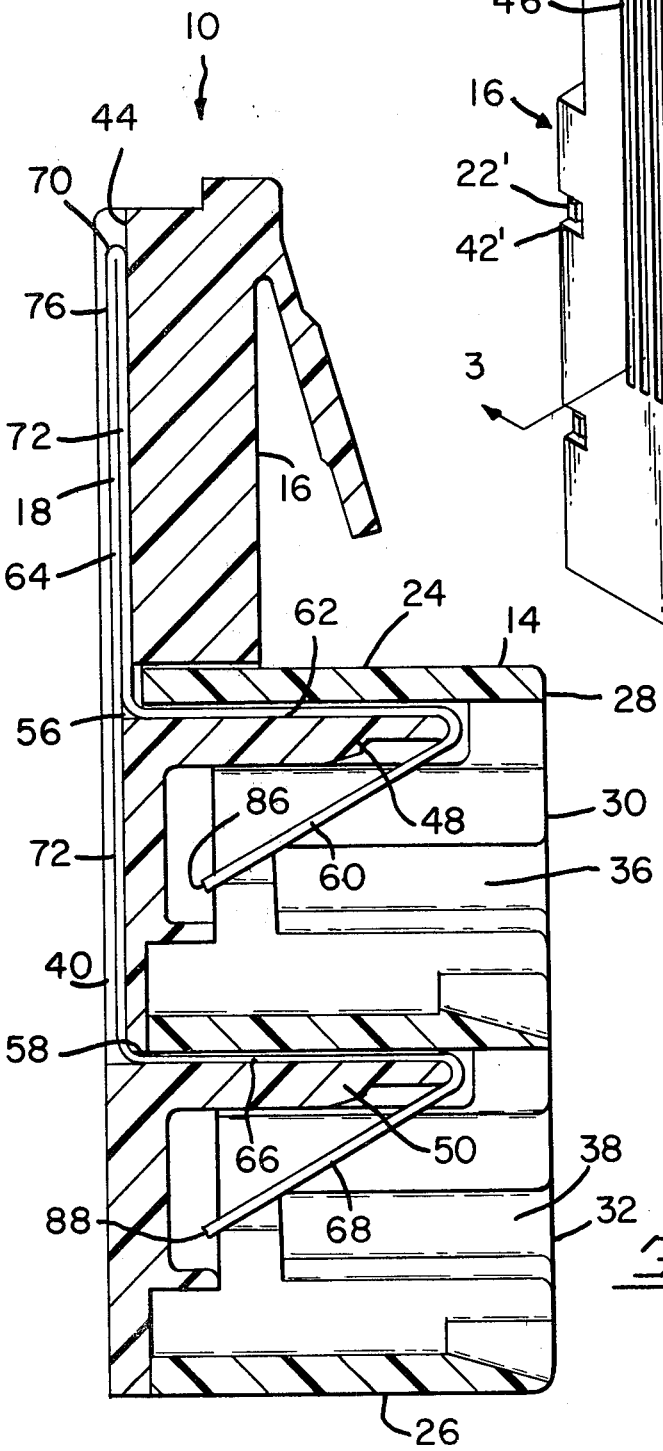
Fig. 3

MODULAR PLUG-DIAL MODULAR JACK ADAPTOR

FIELD OF THE INVENTION

This application is a continuation-in-part of U.S. application Ser. No. 354,974, filed Mar. 5, 1982, now pending.

This invention relates to electrical connectors of the type adapted to connect a modular jack to multiple modular plugs.

BACKGROUND OF THE INVENTION

Modular jacks and modular plugs for telephones are well known. There are situations, however, in the field of telecommunications, where it is desirable to connect two pieces of telephone equipment at one location in parallel with a telephone line at the same location. U.S. Pat. No. 4,295,702 discloses in detail a multi-outlet adaptor for plug-in telephones intended to provide multiple jack access at a single jack location. The adaptor as described in that patent is comprised of a two piece insulating housing, a series of blade contacts for piercing the insulated wire, and a series of insulateed wire conductors terminated at both ends with wire spring contacts.

The present invention is directed to the achievement of an adaptor of the general type as disclosed in U.S. Pat. No. 4,295,702, but having a plurality of one piece uninsulated conductor members which results in fewer parts, greater reliability, lower assembly cost, and other advantages as discussed below.

An important feature of the invention disclosed herein is that it requires tooling for only three different parts, two housing pieces, and the conductor members. The interlocking housing pieces are molded from nylon using straight action molding. The uninsulated one piece conductor members can be stamped and formed from sheet metal. The conductors, therefore, can be made automatically and quickly, thus reducing manufacturing costs. The use of only three different pieces and straight action molding also lower the cost of manufacturing and the assembly time required for each adaptor.

DESCRIPTION OF THE DRAWINGS

FIG. 2 is a perspective view of the assembled modular plug-dual modular jack.

FIG. 3 is a cross-sectional view of the assembled adaptor taken along the line 3—3 of FIG. 2.

PREFERRED EMBODIMENT OF THE INVENTION

Figure 1:
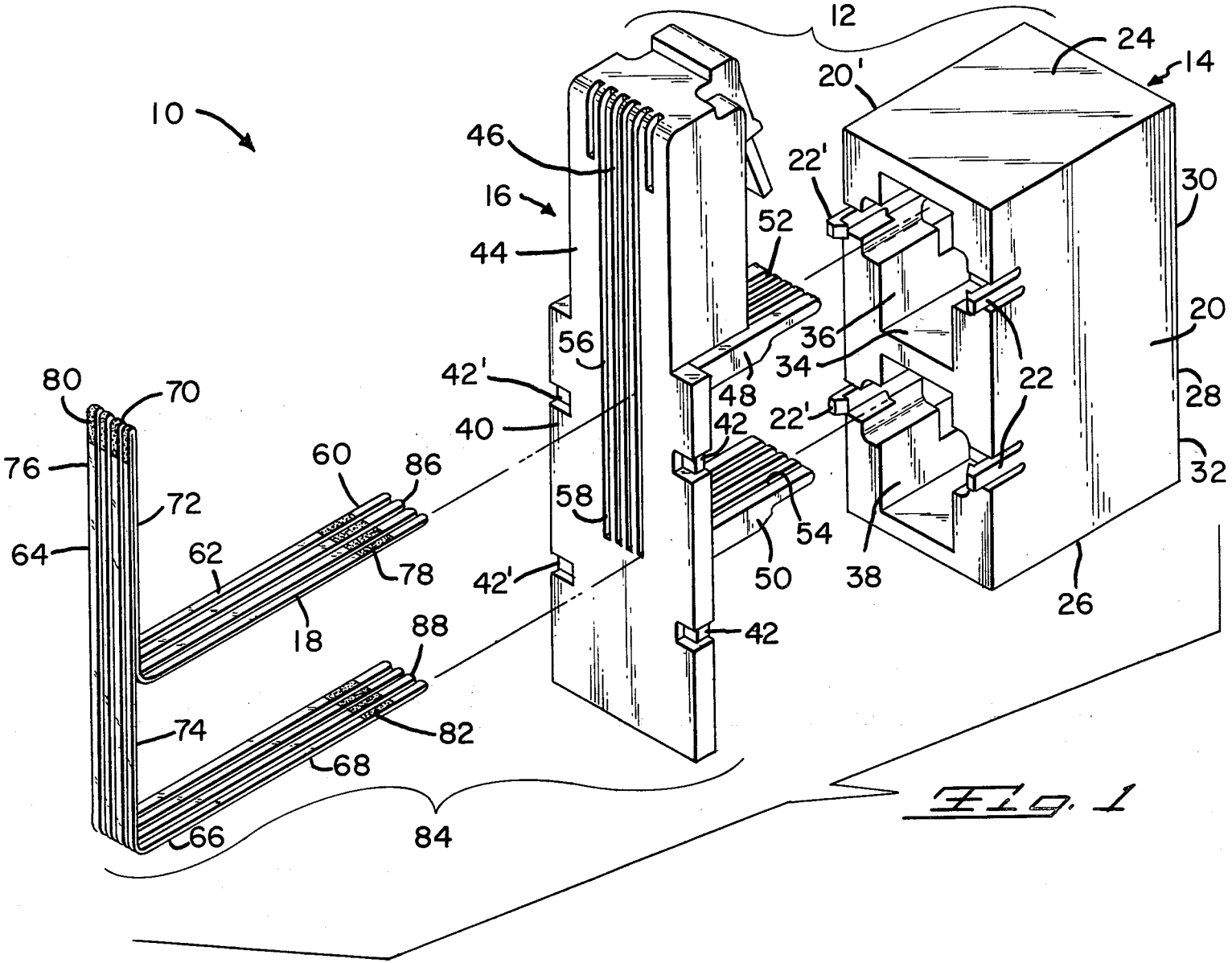
FIG. 1 is a perspective view of the adaptor with the parts exploded from one another.

Referring to FIGS. 1 and 2, the adaptor 10 is comprised of a two piece insulated housing 12 having a jack portion 14 and a plug portion 16 and a plurality of conductor members 18.

Referring now to FIG. 1, the jack portion 14 of the housing 12 is comprised of oppositely facing sidewalls 20 and 20' having locking shoulders 22 and 22' therein; an upper endwall 24, a lower endwall 26 and a front wall 28 having a first plug-receiving face 30 and a second plug-receiving face 32 therein. The jack section 14 further has an internal wall 34, parallel to the endwalls 24 and 26, which divides the jack portion 14 into a first modular jack cavity 36 and second modular jack cavity 38.

The plug portion 16 is comprised of the backwall 40 of the jack portion having lock detents 42 and 42' therein, which cooperate with the shoulder locks 22 and 22' when the adaptor 10 is assembled, and the modular plug 44 extending upwardly and in the common plane of the backwall 40. The external face of the plug 44 and the backwall 40 has a plurality of spaced-apart parallel channels 46 therein for the conductor members 18.

The internal face of the backwall 40 has first and second conductor supports 48 and 50 extending normally therefrom, the first and second conductor supports 48 and 50 being received within the first and second modular jack cavities 36 and 38 respectively. The conductor supports 48 and 50 have a plurality of spaced-apart parallel channels 52 and 54 therein for the conductor members 18. The channels 52 and 54 pass through openings 56 and 58 respectively, in the backwall 40. The conductor support channels 52 and 54 are contiguous with the corresponding plug and backwall channels 46. Corresponding channels in the plug 44, the backwall 40, the first conductor support 48 and the second conductor support 50 lie in the same plane.

The conductor member 18 is comprised of a first jack contact portion 60, a first connecting portion 62, an intermediate portion 64, a second connecting portion 66, and a second jack contact portion 68. The intermediate portion 64 of the conductor 18 has a reversed fold 70 that creates a first parallel section 72 and a second parallel section 74 in that portion of the conductor 18. The intermediate portion 64 further has a plug contact portion 76 in the second parallel section 74. The first connecting portion 62 extends normally from the first parallel section 72 of the intermediate portion 64 to the first jack contact portion 60.

The second connecting portion 66 extends from the second parallel section 74 of the intermediate portion 64 to the second jack contact portion 68. The first jack contact portion 60, the plug contact portion 76 and the second jack contact portion 68 have localized bands of gold plating thereon at 78, 80 and 82 respectively.

As is illustrated by FIGS. 1 and 3, the adaptor 10 is assembled by first inserting the conductor members 18 into the plug portion 16 of the housing 12 and then inserting the conductor plug unit 84 into the jack portion 14 of the housing 12.

In assembling the conductor plug unit 84, the leading ends 86 and 88 of the first and second jack contact portions 56 and 64 respectively, are first inserted into the channels 46 in the backwall 40 and then into and through the openings 56 and 58 respectively in the backwall 40. The conductor members 18 are pushed into the plug portion 16 until the first and second parallel sections 72 and 74 respectively, are seated in the channels 46 in the plug and backwall of the plug portion 16, with the reverse folds 70 at the end of the plug 44. When this position is attained, the first and second connecting portion 62 and 66 are seated in their respective conductor support channels 52 and 54 with the first and second jack contact portions 60 and 68 extending beyond the ends of the conductor supports 48 and 50. The jack contact portions 60 and 68 are then reversely bent around the ends of the conductor supports 48 and 50.

The assembled conductor plug unit 84 is then joined to the jack portion 14 of the housing 12 by inserting the first and second conductor supports 48 and 50 into the corresponding jack cavities 36 and 38 until the locking shoulders 22 and 22′ are engaged with the lock detents 42 and 42′. FIG. 3 shows a cross sectional view of an assembled adaptor.

What is claimed is:

1. A modular plug-dual modular jack adaptor of the type comprising a first modular plug and first and second modular jacks, the modular jacks having plug-receiving faces which lie in a common plane and having backwalls which lie in a common plane which is substantially parallel to, and spaced from, the common plane of the plug-receiving faces, the modular plug extending in the common plane of the backwalls of the modular jacks, a plurality of conductors, each conductor having a first jack contact portion in the first modular jack, a first connecting portion extending from the first modular jack to the modular plug and having an intermediate portion in the modular plug, the intermediate portion being reversely bent upon itself and forming a plug contact in the modular plug, a second connecting portion extending from the intermediate portion to the second modular jack, and a second jack contact portion in the second modular jack, the adaptor being characterized in that:

the first and second modular jacks are side-by-side with the corresponding first and second jack contacts in the first and second modular jacks lying in the same plane, each of the conductors is a continuous one-piece uninsulated conductive member, the intermediate portion comprising first and second parallel sections in the modular plug which extend from the reverse bend to the rearward end of the modular plug, the first connecting portion extending normally from the first parallel section through the back wall of the first modular jack and into the first modular jack, the second connecting portion extending normally from the second parallel section through the back wall of the second modular jack and into the second modular jack whereby, upon mating the modular plug of the adaptor with an additional modular jack and plugging additional modular plugs into the first and second modular jacks, the conductors in the additional modular jack are connected to the corresponding conductors in the additional modular plugs.

2. A modular plug-dual modular jack adaptor as set forth in claim 1 characterized in that the conductors are stamped and formed from sheet metal.

3. A modular plug-dual modular jack adaptor as set forth in claims 1 or 2 characterized in that the back wall of the first and second modular jacks are integral with, and extend in an opposite direction from the modular plug.

4. A modular plug-dual modular jack adaptor as set forth in claim 3 characterized in that the first and second modular jack back walls have first and second conductor supports extending normally therefrom, the first and second conductor supports being received within the first and second modular jacks, the first connecting portions of the conductors being supported on the first conductor support portions and the second connecting portions of the conductors being supported on the second conductor support.

5. A modular plug-dual modular jack adaptor as set forth in claim 4 characterized in that the conductor supports have spaced-apart parallel channels therein, the connecting portions of the conductors being in the channels.

6. A modular plug-dual modular jack adaptor as set forth in claim 3 characterized in that the modular jack back walls are held in assembled relationship to the modular jacks by interengaging latching means.

7. A modular plug-dual modular jack adaptor as set forth in claim 4 characterized in that the modular jack back walls are held in assembled relationship to the modular jacks by interengaging latching means.

8. A modular plug-dual modular jack adaptor as set forth in claim 5 characterized in that the modular jack backwalls are held in assembled relationship to the modular jack by interengaging latching means.

9. A modular plug-dual modular jack adaptor as set forth in claim 2 characterized in that the conductors have localized bands of a precious metal plated on the contact portion of the first and second jack contact portions and on the contact portion of the plug contact.

10. A modular plug-dual modular jack adaptor as set forth in claim 9 further characterized in that the precious metal is gold.

* * * * *